US011890672B1

(12) United States Patent
Li et al.

(10) Patent No.: US 11,890,672 B1
(45) Date of Patent: Feb. 6, 2024

(54) SYSTEM AND METHOD OF MAKING A DIE CAST PART HAVING HIGH WEAR RESISTANCE

(71) Applicant: GM Global Technology Operations LLC, Detroit, MI (US)

(72) Inventors: Zhe Li, Rochester, MI (US); Qigui Wang, Rochester Hills, MI (US); Wenying Yang, Rochester Hills, MI (US); Daniel J. Wilson, Linden, MI (US); Huaxin Li, Rochester Hills, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 0 days.

(21) Appl. No.: 18/161,443

(22) Filed: Jan. 30, 2023

(51) Int. Cl.

| | |
|---|---|
| ***B22D 17/00*** | (2006.01) |
| ***B22D 21/00*** | (2006.01) |
| ***B22D 27/02*** | (2006.01) |
| ***B22D 17/02*** | (2006.01) |

(52) U.S. Cl.
CPC ..... *B22D 17/02* (2013.01); *B22D 21/007* (2013.01); *B22D 27/02* (2013.01)

(58) Field of Classification Search
CPC ..... B22D 17/00; B22D 21/007; B22D 27/02
See application file for complete search history.

(56) References Cited

U.S. PATENT DOCUMENTS 3,165,983 A * 1/1965 Thomas ..... B22D 19/0009 123/193.2
2013/0145899 A1* 6/2013 Song ..... C22B 26/22 75/10.67

* cited by examiner

*Primary Examiner* — Kevin P Kerns
*Assistant Examiner* — Jacky Yuen
(74) *Attorney, Agent, or Firm* — Vivacqua Crane PLLC

(57) ABSTRACT

A method of making a die cast part having high wear resistance is provided. The method comprises providing a mold and an insert pin. The mold comprises an interior surface defining a cavity. The mold comprises a bore formed through the interior surface. The insert pin has a magnetic core having a magnetic field and a barrier disposed about the magnetic core. The insert pin is disposed in the bore and extends into the cavity. The method comprises filling the mold with metallic material such that the metallic material is in contact with the insert pin to define a contact layer. The method comprises modifying iron content within the contact layer with the magnetic field to define an outer layer and an inner layer formed between the outer layer and the insert pin. The inner layer has 3-5 wt % Fe and the outer layer has 0.01-0.5 wt % Fe.

9 Claims, 2 Drawing Sheets

SYSTEM AND METHOD OF MAKING A DIE CAST PART HAVING HIGH WEAR RESISTANCE

INTRODUCTION

The present disclosure relates to die cast parts and, more particularly, systems and methods of making die cast part having high wear resistance.

Many vehicular parts are manufactured by way of die casting. For example, high pressure die casting (HPDC) is a metal casting process that is characterized by forcing molten metal under high pressure into a mold cavity having a predetermined shape of a desired casting. In operation, many of such castings experience undesired wear.

SUMMARY

Thus, while current die casts achieve their intended purpose, there is a need for a new and improved system and method for making a die cast part having high wear resistance.

In accordance with one aspect of the present disclosure, a method of making a die cast part having high wear resistance is provided. The method comprises providing a negative cast mold comprising an interior surface defining a cavity to form the die cast part. The mold comprises a bore formed through the interior surface at an interior opening of the bore. The bore has an inner wall and is in fluid communication with the cavity.

The method further comprises providing an insert pin comprising a first portion extending to a second portion. The first portion comprises a magnetic core having a magnetic field and a barrier disposed about the magnetic core. The second portion is disposed in the bore such that the first portion extends from the interior opening to the cavity. The method further comprises melting the first metallic material at a predetermined temperature to define a molten metallic material. The first metallic material comprises one of aluminum alloy and magnesium alloy. The first metallic material comprises 1 weight (wt) percent (%) iron (Fe) to 2 wt % Fe.

The method further comprises filling the mold with the molten metallic material such that the molten metallic material is in contact with the first portion of the insert pin to define a contact layer of the molten metallic material. The method further comprises modifying Fe content within the contact layer by way of the magnetic field of the magnetic core to define an outer layer adjacent the first portion and an inner layer formed between the outer layer and the first portion.

The method further comprises cooling the molten metallic material to define a solidified metallic material having dimensions of the die cast part. The inner layer has 3 wt % and 5 wt % Fe and the outer layer has 0.01 wt % Fe and 0.5 wt % Fe. The method further comprises detaching the insert pin from the solidified metallic material and removing the inner layer from the solidified metallic material to provide a hole formed by the outer layer thereof defining the die cast part.

In one example, the inner layer has a thickness 10 microns to 500 microns. In another example, the outer layer has a thickness of 0.5 mm to 3 mm. In yet another example, the outer layer has a thickness of 0.1 millimeter (mm) and 5 mm. In still another example, the outer layer comprises 0.05 wt % Fe to 0.2 wt % Fe.

In an example, the magnetic field of the magnetic core comprises a magnetic density of 0.1 tesla (T) to 5 T. In another example, the magnetic core is an electrical magnet. In yet another example, the bore is formed through the mold and the insert pin comprises a cooling line formed therein and extending through the bore. In still another example, the mold comprises an outer thermal protection material disposed thereabout.

In accordance with another aspect of the present disclosure, a system for making a die cast part having high wear resistance is provided. The system comprises a negative cast mold comprising an interior surface defining a cavity to form the die cast part. The mold comprises a bore formed through the interior surface at an interior opening of the bore. The bore has an inner wall and is in fluid communication with the cavity.

The system further comprises an insert pin comprising a first portion extending to a second portion. The first portion comprises a magnetic core having a magnetic field and a barrier disposed about the magnetic core. The second portion is disposed in the bore such that the first portion extends from the interior opening to the cavity.

The system further comprises a furnace arranged to melt the first metallic material at a predetermined temperature to define a molten metallic material. The first metallic material comprises one of aluminum alloy and magnesium alloy. The first metallic material has 1 weight (wt) percent (%) iron (Fe) to 2 wt % Fe.

The system further comprises a feeding mechanism arranged to fill the mold with the molten metallic material such that the molten metallic material is in contact with the first portion of the insert pin to define a contact layer of the molten metallic material. The magnetic field of the magnetic core is arranged to modify Fe content within the contact layer to define an outer layer adjacent the first portion and an inner layer formed between the outer layer and the first portion.

The system further comprises a cooling mechanism arranged to cool the molten metallic material defining a solidified metallic material having dimensions of the die cast part. The inner layer has 3 wt % and 5 wt % Fe and the outer layer has 0.01 wt % Fe and 0.5 wt % Fe.

The system further comprises a detaching mechanism to detach the insert pin from the solidified metallic material and a removing mechanism to remove the inner layer from the solidified metallic material to provide a hole formed by the outer layer thereof defining the die cast part.

In one embodiment, the inner layer has a thickness 10 microns to 500 microns. In another embodiment, the outer layer has a thickness of 0.5 mm to 3 mm. In yet another embodiment, the outer layer has a thickness of 0.1 millimeter (mm) and 5 mm. still another embodiment, the outer layer comprises 0.05 wt % Fe to 0.2 wt % Fe.

In an embodiment, the magnetic field of the magnetic core comprises a magnetic density of 0.1 tesla (T) to 5 T. In another embodiment, the magnetic core is an electrical magnet. In yet another embodiment, the bore is formed through the mold and wherein the insert pin comprises a cooling line formed therein and extending through the bore. In still another embodiment, the mold comprises an outer thermal protection material disposed thereabout.

In accordance with yet another aspect of the present disclosure, a die cast part having high wear resistance against a steel part is provided. The die cast part comprises a die cast body comprising a first metallic material comprising one of aluminum alloy and magnesium alloy and having 1 weight (wt) percent (%) iron (Fe) to 2 wt % Fe. The die cast part further comprises an outer layer disposed about the die cast body. The outer layer comprises 0.01 wt % Fe and 0.5 wt % Fe for contact with and high wear resistance against the steel part. In one embodiment, the outer layer comprises wt % Fe to 0.2 wt % Fe.

Further areas of applicability will become apparent from the description provided herein. It should be understood that the description and specific examples are intended for purposes of illustration only and are not intended to limit the scope of the present disclosure.

BRIEF DESCRIPTION OF THE DRAWINGS

The drawings described herein are for illustration purposes only and are not intended to limit the scope of the present disclosure in any way.

DETAILED DESCRIPTION

The following description is merely exemplary in nature and is not intended to limit the present disclosure, application, or uses.

Aspects of the present disclosure provide systems and methods of making a die cast part having high wear resistance. The systems and methods provide a die cast part having a contact layer with relatively low iron content for high wear resistance. That is, the systems and methods provide a way to modify a contact layer of a die cast part of a vehicle such that the contact layer comprises relatively low iron content. Such low iron content allows for higher resistance to wear against a steel part during operation of the vehicle.

Figure 1:
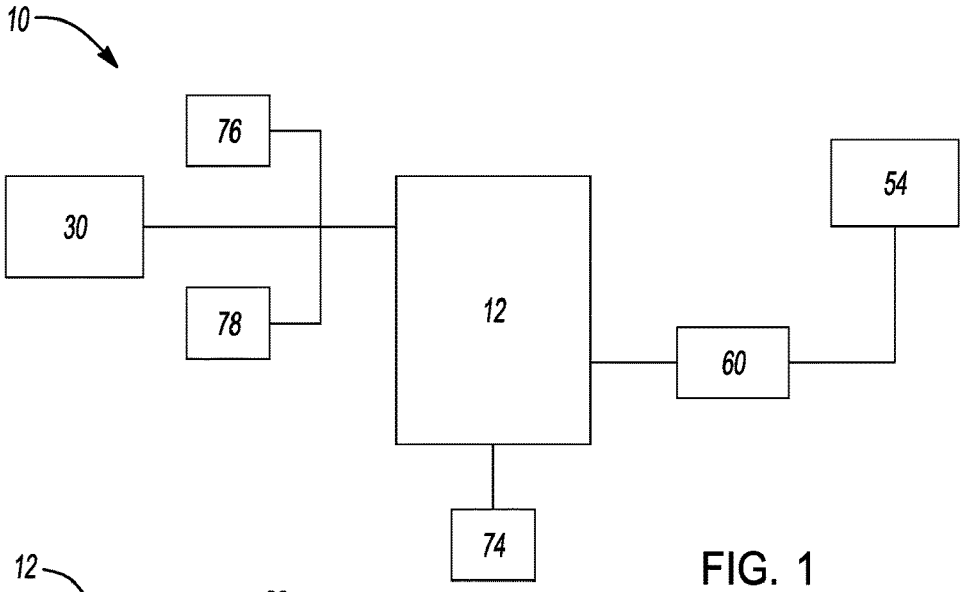
FIG. 1 is a schematic diagram of a system for making a die cast part having high wear resistance in accordance with one embodiment of the present disclosure.
Figure 2A:
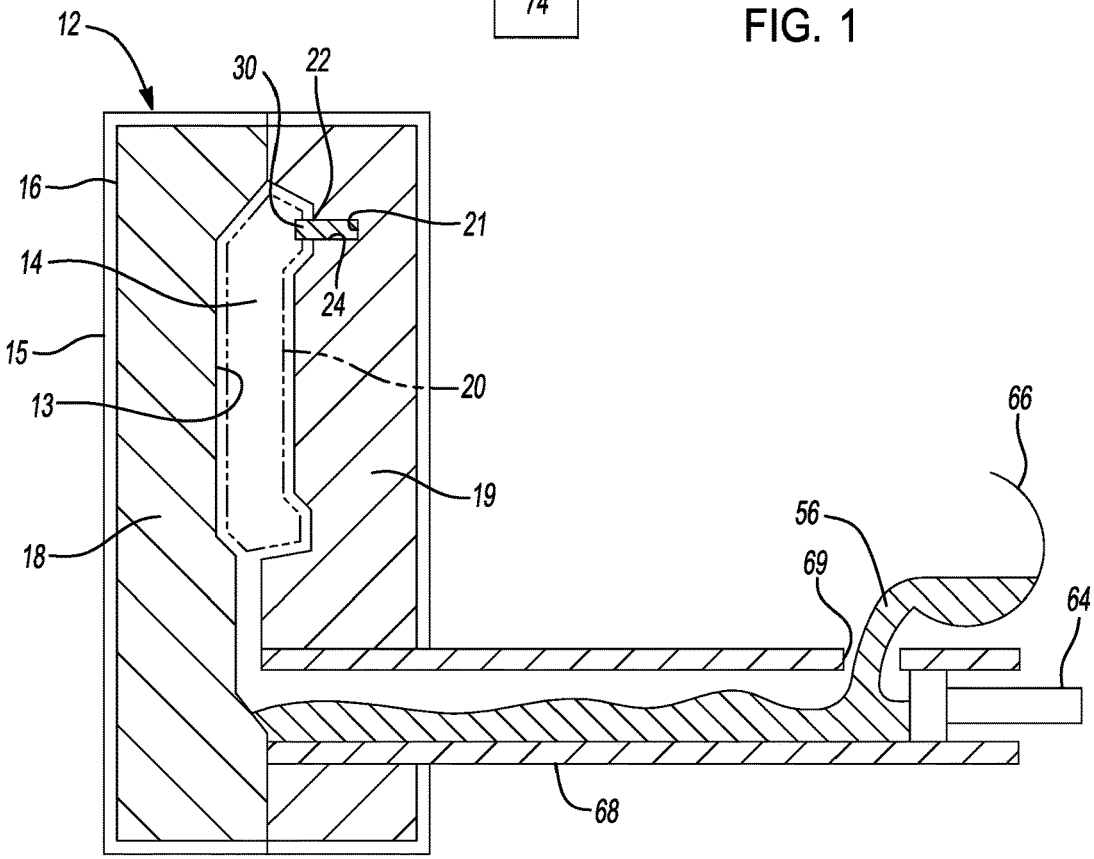
FIG. 2A is a cross-sectional side view of a negative cast mold for making the die cast part of the system in FIG. 1.

FIG. 1 illustrates a system 10 such as a high-pressure die casting system for making a die cast part having high wear resistance in accordance with one embodiment of the present disclosure. As shown in FIGS. 1-2A, the system 10 comprises a negative cast mold 12 comprising an interior surface 13 defining a cavity 14 to form the die cast part. The mold 12 further comprises an exterior surface 15. The cavity 14 is formed to receive molten metallic material 56 to form the die cast part 20 (in phantom), such as an ultra-large casting, having a predetermined shape of the cavity 14. In one embodiment, the mold 12 may comprise an outer thermal protection material 16 disposed thereabout.

As shown in FIG. 2A, the mold 12 is formed of two pieces 18, 19 in which one is a stationary piece 18 and the other is a removable piece 19 arranged to facilitate the removal of a resulting solidified casting or die cast part 20 (in phantom). Aluminum-silicon based alloys may be used for die casting vehicle body components due to the alloys' lightweight, superior moldability, mass producibility, and high strength. Such aluminum-silicon castings or ultra-large castings can have intricate details and varying thicknesses throughout cross-sectional areas of the castings. Load bearing members, such as bosses are commonly designed in aluminum and magnesium castings. For the purpose of this disclosure, a boss is any raised or protuberant part of a casting. A boss may include a bolt hole having internal threads for receiving a threaded bolt or stud. The bolt hole may be a through-hole that extends completely through a cross-section of the boss or a blind-hold that extends partially through the cross-section of the boss.

In this embodiment and as depicted in FIG. 2A, at least one of the mold pieces comprises a bore 21 formed through the interior surface 13 at an interior opening 22 of the bore 21. As depicted, the bore 21 is defined by an inner wall 24 extending to the interior opening 22 and is in fluid communication with the cavity 14. More specifically, the bore 21 is in direct communication with a portion of the mold cavity 14 defining the boss. Furthermore, a portion of the cavity 14 defines a shape of a boss.

Figure 2B:
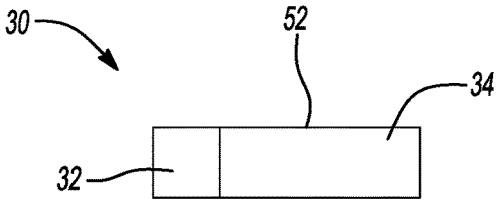
FIG. 2B is a side view of an insert pin for the negative cast mold.

As shown in FIGS. 1-2B, the system 10 further comprises an insert pin 30 comprising a first portion 32 extending to a second portion 34. In this embodiment, the first portion 32 comprises a magnetic core 40 having a magnetic field and a barrier 44 disposed about the magnetic core 40. Moreover, the magnetic core 40 may be a permanent magnet having a magnetic field with a magnetic density of 0.1 tesla (T) to 5 T. Additionally, the magnetic density may be 0.3 T to 3 T, 0.5 T to 1 T, 0.7 T to 0.9 T, 1.1 T to 2.5 T, 0.2 T, 0.7 T, 1.5 T, 2 T, 2.5 T, 3.5 T, 4 T, 4.5 T.

Alternatively, the magnetic core 40 may be an electrical magnet wherein the magnetic field is created by electric current through the magnetic core 40. In this example, the bore 21 may be formed through the mold 12 from the interior surface 13 through the exterior surface 15 allowing electrical wires (not shown) to extend therethrough to the first portion 32 of the insert pin 30 (FIG. 2B). The electrical wires may be connected to an electrical source (not shown) thereby introducing an electrical current through the magnetic core 40 to provide the magnetic field. In this example, the magnetic density is 0.1 tesla (T) to 5 T. Additionally, the magnetic density may be 0.3 T to 3 T, 0.5 T to 1 T, T to 0.9 T, 1.1 T to 2.5 T, 0.2 T, 0.7 T, 1.5 T, 2 T, 2.5 T, 3.5 T, 4 T, 4.5 T.

Figure 3A:
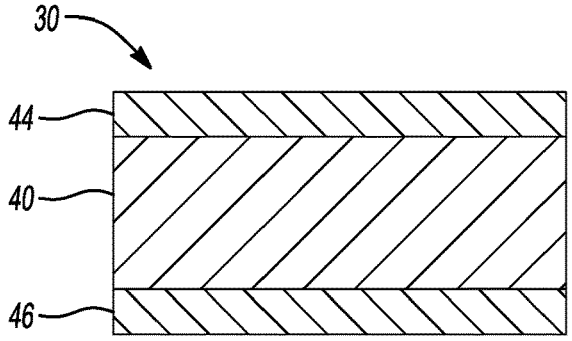
FIG. 3A is a partial cross-sectional side view of an insert pin having a thermal barrier coating for the system in FIG. 1 in accordance with one embodiment.
Figure 3B:
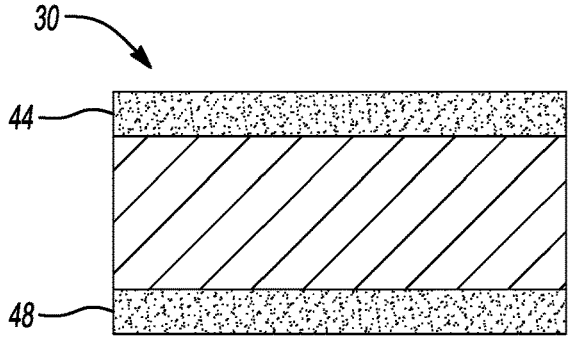
FIG. 3B is a partial cross-sectional side view of an insert pin having an inorganic binder coating for the system in FIG. 1 in accordance with another embodiment.

Preferably, the barrier 44 is a thermal barrier coating, a purpose of which is to protect and reduce heat exposure to the magnetic core 40. Referring to FIG. 3A, the barrier 44 may be an organic thermal barrier coating 46, such as a polymer, disposed about the magnetic core 40. As shown in FIG. 3B, the barrier 44 may be an inorganic thermal barrier coating 48 (such as a sand coating, a chemical bonding sand, clay, or green sand) disposed about the magnetic core 40.

Figure 3C:
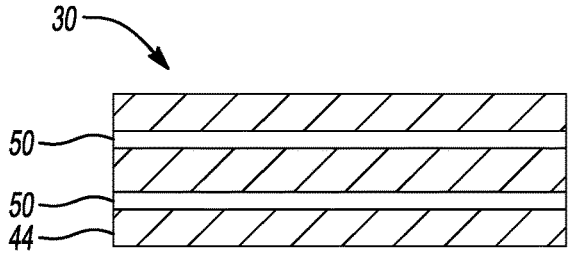
FIG. 3C is a partial cross-sectional side view of an insert pin having internal cooling channels for the system in FIG. 1 in accordance with yet another embodiment.

In another embodiment depicted in FIG. 3C, the barrier 44 comprises cooling channels 50 formed therethrough to allow cooling fluid, e.g., water, to flow through the channels during operation. The cooling fluid is used to protect and reduce heat exposure to the magnetic core 40. In this example, the bore 21 may be formed through the mold 12 from the interior surface 13 through the exterior surface 15 allowing a cooling line (not shown) to extend therethrough to the barrier 44 thereby introducing cooling fluid through the channels. Other suitable ways of introducing cooling fluid through the channel may be used without departing from the spirit or scope of the present disclosure.

Moreover, the second portion 34 is disposed in the bore 21 such that the first portion 32 extends from the interior opening 22 to the cavity 14. Preferably, the inner wall 24 of the bore 21 and an outer surface 52 of the second portion 34 are threaded such that the second portion 34 may be threadedly secured in the bore 21. It is to be understood that other suitable ways of disposing and securing the second portion 34 in the bore 21, such as a threaded collar, may be used without departing from the spirit or scope of the present disclosure.

Referring back to FIG. 1, the system 10 further comprises a furnace 54 arranged to melt a first metallic material at a predetermined temperature to define a molten metallic material 56. In one example, the furnace 54 may have a temperature of between 650 degrees Celsius (° C.) and 900° C. In one embodiment, the furnace 54 may be charged with one of aluminum, aluminum alloy, magnesium, and magnesium alloy. Moreover, the first metallic material has 1 weight (wt) percent (%) iron (Fe) to 2 wt % Fe. The furnace 54 may be an electric arc furnace, an induction furnace, or any other suitable furnace without departing from the spirit or scope of the present disclosure. Moreover, the first metallic material may comprise 7.0 weight percent (wt %) silicon (Si), 0.4 wt % magnesium (Mg), 0.14 wt % iron (Fe), and a balance of aluminum (Al).

Referring to FIG. 2A, an illustration of an exemplary portion of the die cat part, such as an ultra-large casting for a vehicle, is shown in phantom. The die cast part or ultra-large casting may be referred to as a solidified casting or die cast part 20. The ultra-large casting may include one boss having a bolt hole with internal threads. Examples of such ultra-large castings include floorboards, body panels, battery trays, and other load bearing components that have varying cross-sectional thicknesses. The ultra-large casting may be designed and manufactured for on-road vehicles such as passenger car, motorcycles, trucks and trailers, sport utility vehicles (SUVs), and recreational vehicles (RVs), and off-road vehicles such as marine vessels and aircrafts.

Referring to FIGS. 1-2B, the system 10 further comprises a feeding mechanism 60 arranged to fill the mold 12 with the molten metallic material 56 such that the molten metallic material is in contact with the first portion 32 of the insert pin 30 to define a contact layer 62 of the molten metallic material. As shown, the feeding mechanism 60 comprises a plunger mechanism 64, a pouring mechanism 66, and a shot sleeve mechanism 68 for delivering the molten metallic material 56 to the cavity 14. That is, the pouring mechanism 66, such as a ladle, receives and pours molten metallic material 56 through an inlet 69 and in the shot sleeve mechanism 68. In this embodiment, the plunger mechanism 64 is then moved past the inlet 69 and injects the molten metallic material 56 into the cavity 14 to fill the cavity 14, including the portion of the cavity 14 defining the boss, within a prescribed time, temperature, and pressure.

Figure 4:
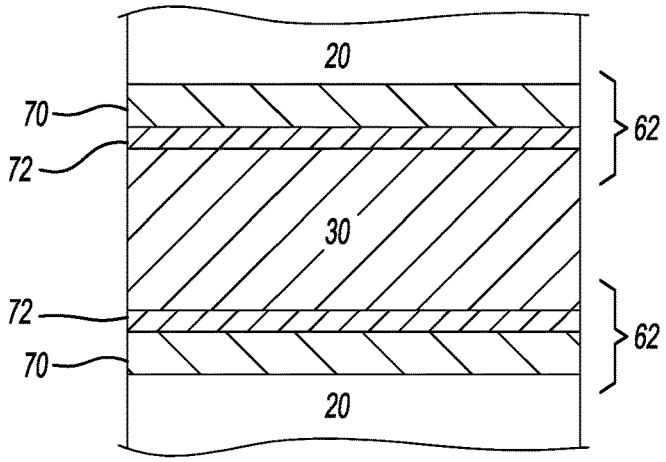
FIG. 4 is a partial cross-sectional side view of an insert pin and a solidified metallic material of the system in FIG. 1 in accordance with one embodiment.

Referring to FIG. 4, when the cavity 14 is filled with the molten metallic material 56, the magnetic field of the magnetic core 40 is arranged to modify iron content within the contact layer 62 to define an outer layer 70 adjacent the first portion 32 and an inner layer 72 formed between the outer layer 70 and the first portion 32. That is, iron atoms are attracted towards the magnetic field at the magnetic core 40. Such attraction results in a higher concentration of iron content at the inner layer 72 and a lesser concentration of iron content at the outer layer 70 relative to the inner layer 72. As a relatively high concentration of iron content at the contact layer 62 is not desirable due to the potential formation of intermetallic material that may cause undesirable wear during operation, the inner layer 72 will be removed from the die cast part upon solidification (described below).

The system 10 further comprises a cooling mechanism 74 arranged to cool the molten metallic material 56 defining a solidified metallic material 20 having dimensions of the die cast part 20. In one embodiment, the molten metallic material 56 is allowed to cool to solidification in the mold 12 to between 400 degrees Celsius (° C.) and 500° C. by way of atmospheric temperature, fluid lines/fans disposed about the mold 12, or by any other suitable manner without departing from the spirit or scope of the present disclosure.

Upon solidification, the inner layer 72 may have a thickness of microns to 500 microns, and preferably 50 microns to 250 microns. Moreover, the outer layer 70 may have a thickness of 0.5 millimeter (mm) to 3 mm, and preferably 0.1 millimeter and 5 mm. Moreover, the outer layer 70 may be comprised of 0.01 wt % Fe to 0.5 wt % Fe, preferably 0.05 wt % Fe to 0.3 wt % Fe, and more preferably 0.2 wt % Fe. In other embodiments, the outer layer 70 may be comprised of 0.02 wt % Fe, 0.06 wt % Fe, 0.1 wt % Fe, 0.15 wt % Fe, wt % Fe, 0.25 wt % Fe, 0.28 wt % Fe, 0.35 wt % Fe, 0.38 wt % Fe, 0.4 wt % Fe, or 0.48 wt % Fe. Furthermore, the inner layer 72 may be comprised of 2 wt % to 6 wt % Fe, 3 wt % Fe to 5 wt % Fe, or 3.5 wt % Fe to 4.5 wt % Fe.

Thus, the outer layer 70 comprises a relatively low iron content, e.g., 0.01 wt % Fe to 0.5 wt % Fe, due to attraction of iron atoms to towards the magnetic field of the magnetic core 40. As a result, the inner layer 72 comprises a relatively high iron content, e.g., 2 wt % to 6 wt % Fe. Given its higher iron content, the inner layer 72 will be removed from the contact layer 62 of the solidified metallic material 20 (in phantom) as described below. Removal of the inner layer 72 provides higher wear resistance during operation.

Referring to FIG. 1, the system 10 further comprises a detaching mechanism 76 to detach the insert pin 30 from the solidified metallic material 20. For example, the detaching mechanism 76 may be a robotic arm arranged to detach the insert pin 30 from the solidified metallic material 20 to provide an unmachined hole formed by the inner layer 72.

Moreover, the system 10 further comprises a removing mechanism 78 to remove the inner layer 72 from the solidified metallic material 20 to provide a machined hole defined by the outer layer 70 of the die cast part. For example, the removing mechanism 78 may be any suitable machining device that removes or machines away the inner layer 72 from the solidified metallic material 20. Given its lower iron content, the outer layer 70 provides higher wear resistance since negligible or no intermetallic material will be formed at the outer layer 70 against a steel part during operation.

The solidified metallic material 20 may then be ejected from the mold 12 by any suitable manner known in the art. For example, the removable piece 19 of the mold 12 may be moved from the stationary piece 18 of the mold 12, and a robotic mechanism may be implemented to eject the solidified metallic material 20 therefrom. The solidified metallic material 20 may then be machined to design dimensions and tolerances, and heat treated as necessary to desired specifications. Furthermore, it is understood that one controller or a plurality of controllers may be used to control each unit/mechanism described herein.

Figure 5:
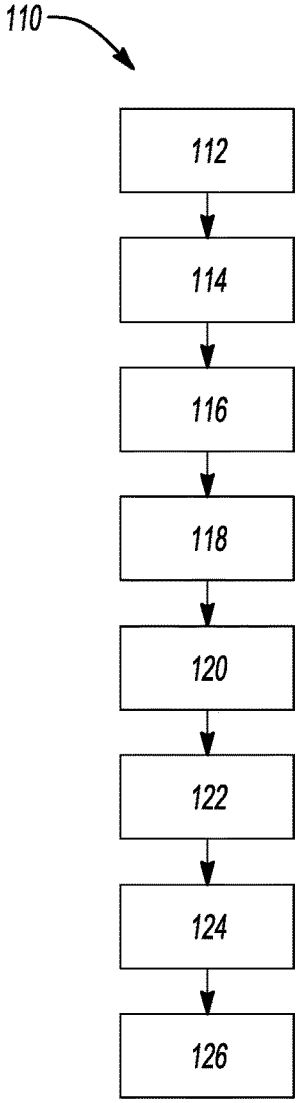
FIG. 5 is a flowchart for a method of making a die cast part having high wear resistance in accordance with one embodiment of the present disclosure.

FIG. 5 illustrates a flowchart of a method 110 of making a die cast part having high wear resistance in accordance with one example of the present disclosure. In this example, the method 110 may be implemented by the system 10 of FIG. 1. The method 110 comprises in box 112 providing a negative cast mold 12 comprising an interior surface 13 defining a cavity 14 to form the die cast part. The mold 12 further comprises an exterior surface 15. The cavity 14 is formed to receive molten metallic material 56 to form the die cast part 20 (in phantom), such as an ultra-large casting, having a predetermined shape of the cavity 14. In one embodiment, the mold 12 may comprise an outer thermal protection material 16 disposed thereabout.

As discussed above and shown in FIG. 2A, the mold 12 is formed of two pieces 18, 19 in which one is a stationary piece 18 and the other is a removable piece 19 arranged to facilitate the removal of a resulting solidified casting 20. In this example and as depicted in FIG. 2, at least one of the mold pieces comprises a bore 21 formed through the interior surface 13 at an interior opening 22 of the bore 21. As depicted, the bore 21 is defined by an inner wall 24 extending to the interior opening 22 and is in fluid communication with the cavity 14. More specifically, the bore 21 is in direct communication with a portion of the mold cavity 14 defining the boss 124. Furthermore, a portion of the cavity 14 defines a shape of a boss.

Referring to FIG. 5, the method 110 further comprises in box 114 providing an insert pin 30 (FIG. 2B) comprising a first portion 32 extending to a second portion 34. In this example, the first portion 32 comprises a magnetic core 40 having a magnetic field and a barrier 44 disposed about the magnetic core 40. Moreover, the magnetic core 40 may be a permanent magnet having a magnetic field with a magnetic density of 0.1 tesla (T) to 5 T. Additionally, the magnetic density may be 0.3 T to 3 T, 0.5 T to 1 T, 0.7 T to 0.9 T, 1.1 T to 2.5 T, 0.2 T, 0.7 T, 1.5 T, 2 T, 2.5 T, 3.5 T, 4 T, 4.5 T.

Preferably, the barrier 44 is a thermal barrier coating, a purpose of which is to protect and reduce heat exposure to the magnetic core 40. As referred to in FIG. 3A, the barrier 44 may be an organic thermal barrier coating 46, such as a polymer, disposed about the magnetic core 40. As referred to in FIG. 3B, the barrier 44 may be an inorganic thermal barrier coating 48 (such as a sand coating, a chemical bonding sand, clay, or green sand) disposed about the magnetic core 40.

Moreover, the second portion 34 is disposed in the bore 21 such that the first portion 32 extends from the interior opening 22 to the cavity 14. Preferably, the inner wall 24 of the bore 21 and an outer surface 52 of the second portion 34 are threaded such that the second portion 34 may be threadedly secured in the bore 21. It is to be understood that other suitable ways of disposing and securing the second portion 34 in the bore 21, such as a threaded collar, may be used without departing from the spirit or scope of the present disclosure.

As shown in FIG. 5, the method 110 further comprises in box 116 melting the first metallic material at a predetermined temperature to define a molten metallic material. As discussed above, a furnace 54 is arranged to melt a first metallic material at a predetermined temperature to define a molten metallic material. In one example, the furnace 54 may have a temperature of between 650 degrees Celsius (° C.) and 900° C. In one embodiment, the furnace 54 may be charged with one of aluminum, aluminum alloy, magnesium, and magnesium alloy. Moreover, the first metallic material has 1 weight (wt) percent (%) iron (Fe) to 2 wt % Fe. The furnace 54 may be an electric arc furnace, an induction furnace, or any other suitable furnace without departing from the spirit or scope of the present disclosure. Moreover, the first metallic material may comprise 7.0 weight percent (wt %) silicon (Si), 0.4 wt % magnesium (Mg), 0.14 wt % iron (Fe), and a balance of aluminum (Al).

As depicted in FIG. 5, the method 110 further comprises in box 118 filling the mold 12 with the molten metallic material 56 such that the molten metallic material 56 is in contact with the first portion 32 of the insert pin to define a contact layer 62 of the molten metallic material 56. In one example and as shown in FIGS. 1-2A, the feeding mechanism 60 comprises a plunger mechanism 64, a pouring mechanism 66, and a shot sleeve system for delivering the molten metallic material 56 to the cavity 14. That is, the pouring mechanism 66, such as a ladle, receives and pours molten metallic material 56 through an inlet 69 and in the shot sleeve mechanism 68. In this embodiment, the plunger mechanism 64 is then moved past the inlet 69 and injects the molten metallic material 56 into the cavity 14 to fill the cavity 14, including the portion of the cavity 14 defining the boss, within a prescribed time, temperature, and pressure.

Referring to FIG. 5, the method 110 further comprises in box 120 modifying Fe content within the contact layer 62 by way of the magnetic field of the magnetic core 40 to define an outer layer 70 adjacent the first portion 32 and an inner layer 72 formed between the outer layer 70 and the first portion 32. In this example, when the cavity 14 is filled with the molten metallic material 56, the magnetic field of the magnetic core 40 is arranged to modify iron content within the contact layer 62 to define an outer layer 70 adjacent the first portion 32 and an inner layer 72 formed between the outer layer 70 and the first portion 32. That is, iron atoms are attracted towards the magnetic field at the magnetic core 40. Such attraction results in a higher concentration of iron content at the inner layer 72 and a lesser concentration of iron content at the outer layer 70 relative to the inner layer 72. As a relatively high concentration of iron content at the contact layer 62 is not desirable due to the potential formation of intermetallic material that may cause undesirable wear during operation, the inner layer 72 will be removed from the die cast part upon solidification.

As shown in FIG. 5, the method 110 further comprises in box 122 cooling the molten metallic material 56 to define a solidified metallic material 20 having dimensions of the die cast part. In one example, a cooling mechanism 74 is arranged to cool the molten metallic material 56 defining a solidified metallic material 20 having dimensions of the die cast part. Here, the molten metallic material 56 is allowed to cool to solidification in the mold 12 to between 400 degrees Celsius (° C.) and 500° C. by way of atmospheric temperature, fluid lines/fans disposed about the mold 12, or by any other suitable manner without departing from the spirit or scope of the present disclosure.

Upon solidification, the inner layer 72 may have a thickness of microns to 500 microns, and preferably 50 microns to 250 microns. Moreover, the outer layer 70 may have a thickness of 0.5 millimeter (mm) to 3 mm, and preferably 0.1 millimeter and 5 mm. Moreover, the outer layer 70 may be comprised of 0.01 wt % Fe to 0.5 wt % Fe, preferably 0.05 wt % Fe to 0.3 wt % Fe, and more preferably 0.2 wt % Fe. In other embodiments, the outer layer 70 may be comprised of 0.02 wt % Fe, 0.06 wt % Fe, 0.1 wt % Fe, 0.15 wt % Fe, wt % Fe, 0.25 wt % Fe, 0.28 wt % Fe, 0.35 wt % Fe, 0.38 wt % Fe, 0.4 wt % Fe, or 0.48 wt % Fe. Furthermore, the inner layer 72 may be comprised of 2 wt % to 6 wt % Fe, 3 wt % Fe to 5 wt % Fe, or 3.5 wt % Fe to 4.5 wt % Fe.

Thus, the outer layer 70 comprises a relatively low iron content, e.g., 0.01 wt % Fe to 0.5 wt % Fe, due to attraction of iron atoms to towards the magnetic field of the magnetic core 40. As a result, the inner layer 72 comprises a relatively high iron content, e.g., 2 wt % to 6 wt % Fe. Given its higher iron content, the inner layer 72 will be removed from the contact layer 62 of the solidified metallic material 20 as described below. Removal of the inner layer 72 provides higher wear resistance during operation.

FIG. 5 illustrates the method 110 further comprises in box 124 detaching the insert pin 30 from the solidified metallic material 20. For example, a detaching mechanism 76 may be arranged to detach the insert pin 30 from the solidified metallic material 20. As discussed, the detaching mechanism 76 may be a robotic arm arranged to detach the insert pin 30 from the solidified metallic material 20 to provide an unmachined hole formed by the inner layer 72.

The method 110 further comprises in box 126 removing the inner layer 72 from the solidified metallic material 20 to provide a hole formed by the outer layer 70 thereof defining the die cast part. For example, a removing mechanism 78 may be arranged to remove the inner layer 72 from the solidified metallic material 20 to provide a machined hole defined by the outer layer 70 of the die cast part. As discussed, the removing mechanism 78 may be any suitable machining device that removes or machines away the inner layer 72 from the solidified metallic material 20. Given its lower iron content, the outer layer 70 provides higher wear resistance since negligible or no intermetallic material will be formed at the outer layer 70 against a steel part during operation.

The solidified metallic material 20 may then be ejected from the mold 12 by any suitable manner known in the art. For example, the removable piece 19 of the mold 12 may be moved from the stationary piece 18 of the mold 12, and a robotic mechanism may be implemented to eject the solidified metallic material 20 therefrom. The solidified metallic material 20 may then be machined to design dimensions and tolerances, and heat treated as necessary to desired specifications.

The description of the present disclosure is merely exemplary in nature and variations that do not depart from the gist of the present disclosure are intended to be within the scope of the present disclosure. Such variations are not to be regarded as a departure from the spirit and scope of the present disclosure.

What is claimed is:

1. A method of making a die cast part, the method comprising:

providing a negative cast mold comprising an interior surface defining a cavity to form the die cast part, the mold comprising a bore formed through the interior surface at an interior opening of the bore, the bore having an inner wall and being in fluid communication with the cavity;

providing an insert pin comprising a first portion extending to a second portion, the first portion comprising a magnetic core having a magnetic field and a barrier disposed about the magnetic core, the second portion disposed in the bore such that the first portion extends from the interior opening to the cavity;

melting a first metallic material at a predetermined temperature to define a molten metallic material, the first metallic material comprising one of aluminum alloy and magnesium alloy, the first metallic material having 1 weight (wt) percent (%) iron (Fe) to 2 wt % Fe;

filling the mold with the molten metallic material such that the molten metallic material is in contact with the first portion of the insert pin to define a contact layer of the molten metallic material;

modifying Fe content within the contact layer by way of the magnetic field of the magnetic core to define an outer layer and an inner layer formed between the outer layer and the first portion;

cooling the molten metallic material to define a solidified metallic material having dimensions of the die cast part, the inner layer having 3 wt % to 5 wt % Fe and the outer layer having 0.01 wt % Fe to 0.5 wt % Fe;

detaching the insert pin from the solidified metallic material; and removing the inner layer from the solidified metallic material to provide a hole formed by the outer layer thereof defining the die cast part.

2. The method of claim 1 wherein the inner layer has a thickness of 10 microns to 500 microns.

3. The method of claim 1 wherein the outer layer has a thickness of 0.5 mm to 3 mm.

4. The method of claim 1 wherein the outer layer has a thickness of 0.1 millimeter (mm) to 5 mm.

5. The method of claim 1 wherein the outer layer comprises 0.05 wt % Fe to 0.2 wt % Fe.

6. The method of claim 1 wherein the magnetic field of the magnetic core comprises a magnetic density of 0.1 tesla (T) to 5 T.

7. The method of claim 1 wherein the magnetic core is an electrical magnet.

8. The method of claim 1 wherein the bore is formed through the mold and wherein the insert pin comprises a cooling line formed therein and extending through the bore.

9. The method of claim 1 wherein the mold comprises an outer thermal protection material disposed thereabout.

* * * * *